US007069899B1

(12) United States Patent
Okuda et al.

(10) Patent No.: US 7,069,899 B1
(45) Date of Patent: Jul. 4, 2006

(54) OIL PAN MOUNTING STRUCTURE

(75) Inventors: Tsutomu Okuda, Gifu-ken (JP); Kenichi Yamada, Aichi-ken (JP)

(73) Assignees: Pacific Industrial Co., Ltd., Gifu-ken (JP); Toyota Jidosha Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/142,185

(22) Filed: Jun. 1, 2005

(30) Foreign Application Priority Data

Mar. 29, 2005 (JP) ..... 2005-093914

(51) Int. Cl.
*F02F 77/00* (2006.01)

(52) U.S. Cl. ..... 123/195 C; 184/6.22

(58) Field of Classification Search ..... 123/195 C; 184/6.22, 104.2

See application file for complete search history.

(56) References Cited

FOREIGN PATENT DOCUMENTS

| | | |
|---|---|---|
| JP | 2003-222012 | 8/2003 |
| JP | 2005-009418 | 1/2005 |

*Primary Examiner*—Noah P. Kamen
(74) *Attorney, Agent, or Firm*—Akin Gump Strauss Hauer & Feld, LLP

(57) ABSTRACT

A mounting structure for an oil pan is disclosed. The oil pan includes an outer pan made from a metal and an inner pan made from a synthetic resin and fixed to an underside of an engine by bolts. The mounting structure includes abutments formed on outer portions of the opening edges of outer pan and the engine so as to abut against each other, respectively, bolt engagement holes formed through the outer peripheral portions of the opening edges so that the bolts are inserted through the holes respectively, an accommodation space defined between inner peripheral portions of the opening edges of the outer pan and the engine by collapsing the inner peripheral portion of the opening edge of either outer pan or engine, and a flange protruding sideways from the inner pan and loosely fitted in the accommodation space.

6 Claims, 5 Drawing Sheets

OIL PAN MOUNTING STRUCTURE

BACKGROUND OF THE INVENTION

1. Field of the Invention

This invention relates to a mounting structure for an oil pan comprising an outer pan made from a metal and an inner pan made from a synthetic resin and bolted to the underside of an engine.

2. Description of the Related Art

In conventional engine oil pans of the above-described type, an inner pan is bolted to an inner surface of an outer pan (see JP-A-2005-9418, for example) or the inner pan has a flange held between the outer pan and an engine and fastened by bolts (JP-A-2003-222012, for example).

However, the inner pan, which is made from a synthetic resin, has a thermal deformation ratio different from those of the outer pan and engine, both of which are made from respective metals. Accordingly, an internal stress occurs in the inner pan with thermal deformation thereof, resulting in possibility of cracks produced in the inner pan. Furthermore, when held between the outer pan and the engine and fastened by bolts, the flange of the inner pan may creep such that the sealing performance would be reduced in the co-fastened portion.

SUMMARY OF THE INVENTION

Therefore, an object of the present invention is to provide a mounting structure for an oil pan which can prevent the inner pan from cracking and has a high sealing performance.

The present invention provides a mounting structure for an oil pan including an outer pan made from a metal and an inner pan made from a synthetic resin and bolted to an underside of an engine, the outer pan having an upper opening edge and the engine having an underside with an opening edge. The mounting structure includes abutments provided on outer peripheral portions of the opening edges of the outer pan and the engine so as to abut against each other, respectively, bolt insertion holes formed through the outer peripheral portions of the opening edges so that bolts are inserted through the holes respectively, an accommodation space defined between inner peripheral-portions of the opening edges of the outer pan and the engine by collapsing the inner peripheral portion of the opening edge of either outer pan or engine, and a flange protruding sideways from the inner pan and loosely fitted in the accommodation space.

The flange of the inner pan is loosely fitted in the accommodation space defined between the inner peripheral portions of the opening edges of the outer pan and the engine. The inner pan is held by the outer pan and the engine while being allowed to be thermally deformed. Consequently, an internal stress due to thermal deformation is hard to occur in the inner pan, whereupon the inner pan can be prevented from cracking. Furthermore, the outer peripheral portions of the opening edges of the outer pan and the engine are in abutment with each other without the flange being held therebetween. Consequently, the sealing performance can be prevented from being reduced by creep deformation.

In one form of the invention, the mounting structure further comprises rugged engagement portions provided in the opening edges of the outer pan or engine and the flange so as to be loosely fitted with each other vertically, respectively. Consequently, the flange can be prevented from falling off while being allowed to move in the accommodation space.

In another form of the invention, the mounting structure further comprises inner pan retainers provided on the inner and outer pans so as to be engaged with each other, the inner pan retainers retaining the inner pan at a normal position where the inner pan is assembled to the outer pan. When the inner pan has been assembled to the normal position of the outer pan, the inner and outer pans are prevented from falling off by the inner pan retainers thereby to be integrated with each other. Consequently, the oil pan can be attached to and detached from the engine more efficiently.

BRIEF DESCRIPTION OF THE DRAWINGS

Other objects, features and advantages of the present invention will become clear upon reviewing the following description of the embodiments with reference to the accompanying drawings, in which.

DETAILED DESCRIPTION OF THE INVENTION

Figure 1:
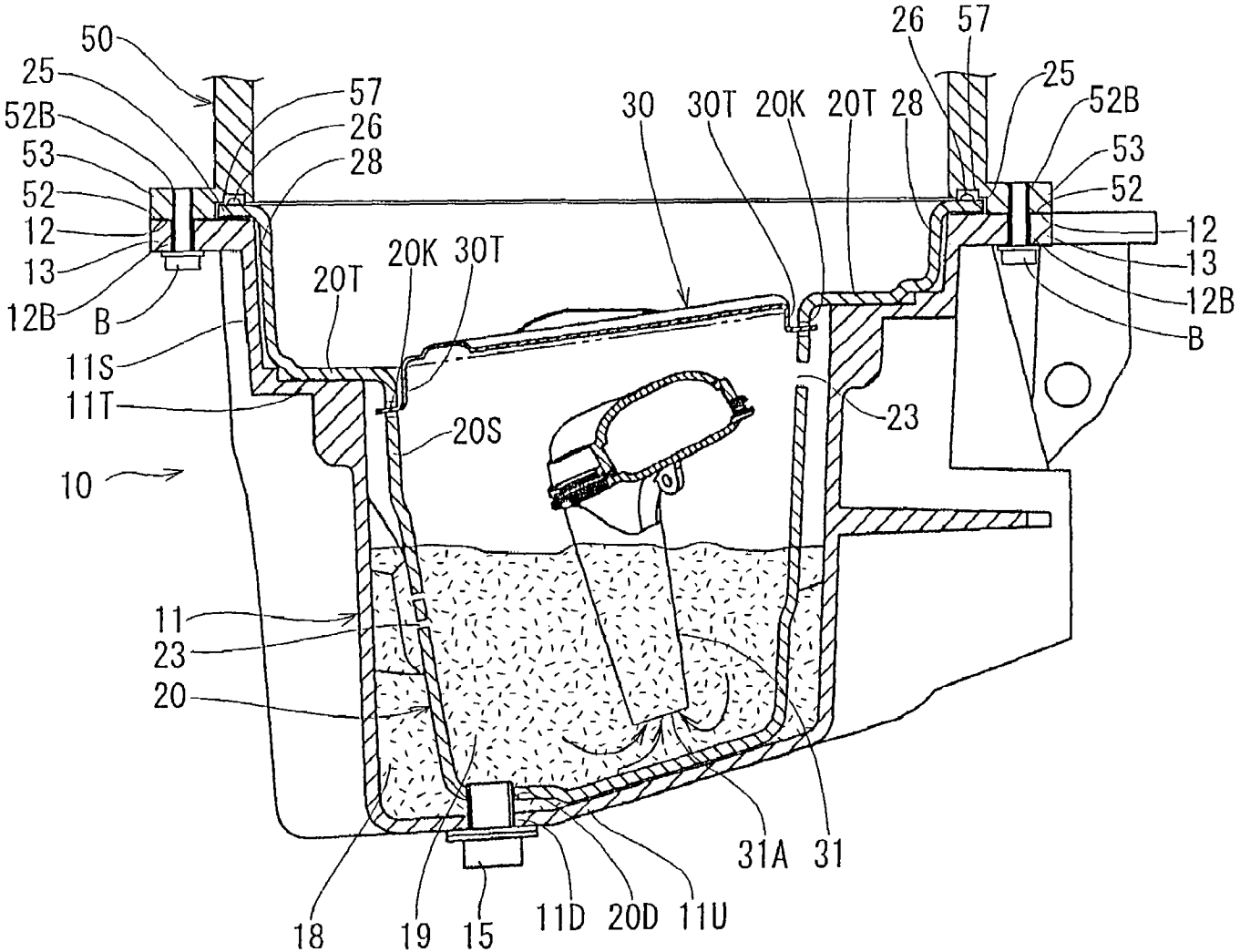
FIG. 1 is a side section of an oil pan of one embodiment in accordance with the present invention.
Figure 2:
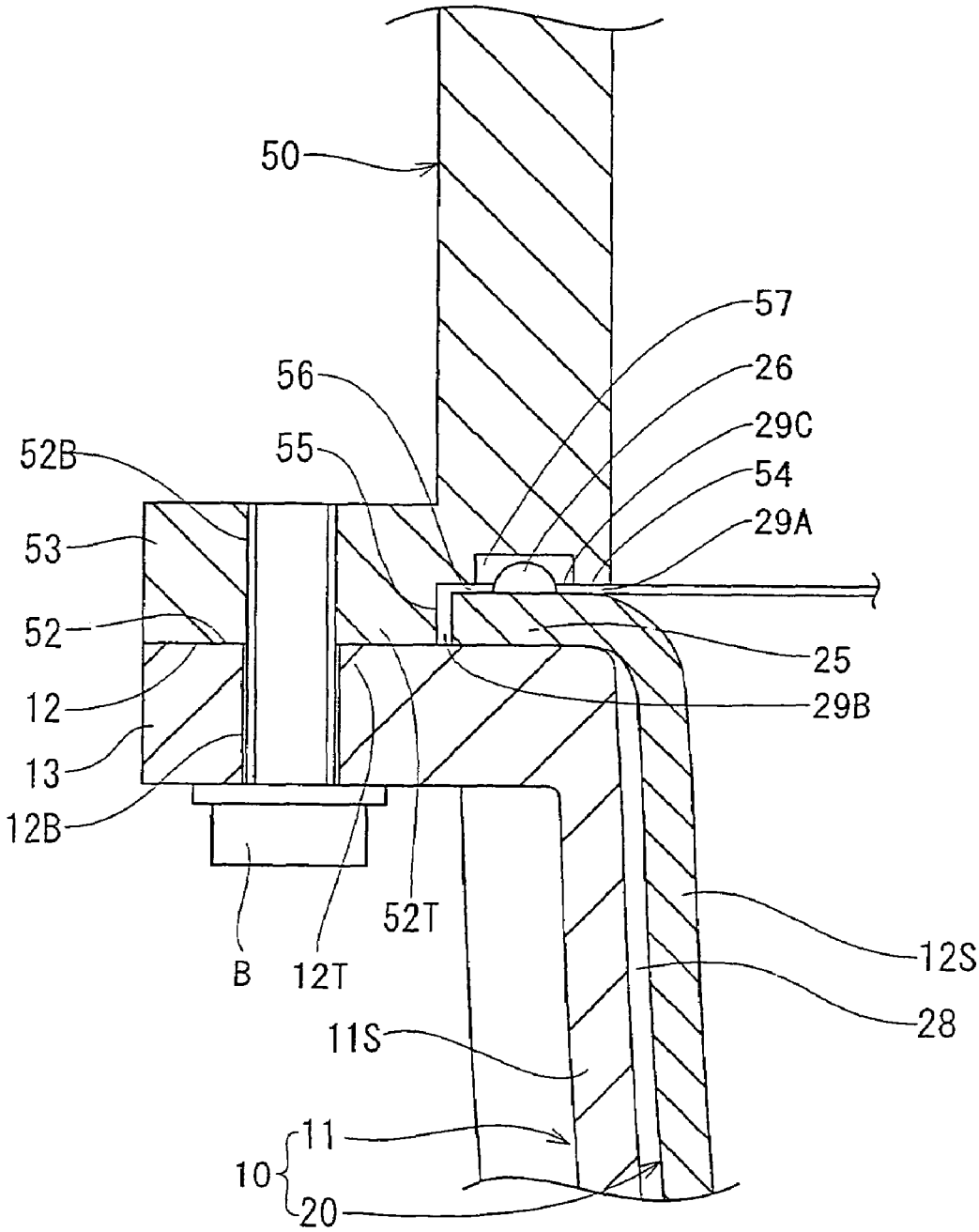
FIG. 2 is a partial side section of an engine and the oil pan.

A first embodiment of the present invention will be described with reference to FIGS. 1 and 2. Referring to FIG. 1, reference numeral 50 designates an engine having an underside with an opening edge 52. The opening edge 52 has a flange 53 protruding sideways. An oil pan 10 of the first embodiment is mounted on the opening edge 52 including the flange 53. The oil pan 10 includes an outer pan 11 and an inner pan 20 disposed in the outer pan 11. The outer pan 11 is made from a metal and formed into the shape of a container with an upper open end. The outer pan 11 has a flange 13 protruding sideways from an opening edge 12 thereof.

The outer pan 11 includes a side wall 11S with a shelf 11T formed by bending a part thereof near the upper end into the shape of a crank. An interior of the outer pan 11 below the shelf 11T is narrower than an interior of the outer pan 11 over the shelf 11T. The outer pan 11 further includes a bottom 11U formed with a drain hole 11D. The drain hole 11D is formed so as to be located lowest when the oil pan 10 is assembled to the engine 50. A drain bolt 15 is inserted into the drain hole 11D from outside the outer pan 11. Oil reserved in the oil pan 10 flows out when the drain bolt 15 is detached out of the drain hole 11D.

The inner pan 20 is made from a synthetic resin such as nylon and formed into the shape of a container with an upper open end. The inner pan 20 includes a side wall 20S with a shelf 20T formed by bending a part thereof near the upper end into the shape of a crank. An interior of the inner pan 20 below the shelf 20T is narrower than an interior of the inner pan 20 over the shelf 20T. The shelf 20T of the inner pan 20 is placed on an upper surface of the shelf 11T of the outer pan 11 so that the interior of the outer pan 11 below the shelves 11T and 20T is divided into an outer chamber 18 outside the inner pan 20 and an inner chamber 19 inside the inner pan 20. A suction pipe 31 extending downward from the engine 50 side has a distal end located in the inner chamber 19. When an oil suction pump (not shown) is driven, oil in the inner chamber 19 is sucked into a suction port 31A of the lower end of the suction pipe 31. The oil sucked into the suction pipe 31 comes into contact with parts of the engine 50, lubricating and cooling the parts. Thereafter, the oil falls down from over the oil pan 10 to return into the inner chamber 19.

A middle opening of the inner pan 20 surrounded by the shelf 20T is closed by a baffle plate 30. The suction pipe 31 extends through a hole (not shown) formed in the baffle plate 30. The baffle plate 30 has a plurality of locking claws 30T formed on an outer edge thereof. The locking claws 30T engage respective locking holes 20K formed through a part of the side wall located near the underside of the shelf 20T of the inner pan 20. As a result, the baffle plate 30 is held in a closing state, thereby limiting upward movement of the oil in the inner pan 20.

The inner pan 20 has a plurality of lateral holes 23 formed through a part of the side wall 20S located below the shelf 20T. Oil is suitably circulated through the lateral holes 23 between the inner and outer chambers 19 and 18. The inner pan 20 further has a bottom 20U through which a drain hole 20D is formed. The drain hole 20D is closed by the drain bolt 15 inserted through the drain hole 11D of the outer pan 11.

The inner pan 20 has a protruding wall or flange 25 protruding sideways from the upper end thereof. The flange 25 extends along an entire upper periphery of the inner pan 20, for example. The flange 25 is placed on an inner peripheral portion of flat upper surface of the opening edge 12. The flange 25 has a plurality of embossments 26 formed on an upper surface of the flange 25. Each embossment 26 is formed into a semispherical shape.

The opening edge 12 of the outer pan 11 includes an outer portion spaced away from the flange 25. The outer peripheral portion of the opening edge 12 serves as an abutment 12T. The abutment 12 has a plurality of bolt holes 12B formed therethrough. The opening edge 52 of the engine 50 also includes an outer peripheral portion also serving as an abutment 52T. The abutment 52T has a plurality of female screw holes 52B formed therethrough. The bolt holes 12B and the female screw holes 52B constitute a bolt engagement hole.

The opening edge 52 of the engine 50 includes an inner peripheral portion formed with a collapsed surface 54 collapsed from the outer peripheral portion into a stepped shape. Bolts B inserted through the bolt holes 12B of the outer pan 11 from below are brought into threading engagement with the female screw holes 52B of the engine 50 respectively. As a result, the outer peripheral portions of the opening edges 12 and 52, namely, the abutments 12T and 52T are abutted against each other, whereby the outer pan 11 is fixed to the engine 50, and an accommodation space 56 is defined between the collapsed surface 54 of the engine 50 and the inner peripheral portion of the opening edge 12 of the outer pan 11. The flange 25 of the inner pan 20 is loosely fitted in the accommodation space 56. Furthermore, the collapsed surface 54 is formed with a plurality of recesses 57 in which the embossments 26 of the flange 25 are loosely fitted.

The aforesaid "loosely fitted" refers to a state where a component is fitted in another component with a gap therebetween. Accordingly, when a component is loosely fitted in another component, each component is movable in a range of the gap. More specifically, a gap is defined between the upper surface of the opening edge 12 of the outer pan 11 and the collapsed surface 54. The gap is slightly larger than a thickness of the flange 25 such that a gap 29A is defined between the collapsed surface 54 and the flange 25. Further, another gap 29B is defined between a stepped surface 55 of the engine opening edge 52 and an outer peripheral surface of the flange 25. Still further, a gap 29C is defined between an inner surface of the recess 57 and the embossment 26. Furthermore, a gap 28 is also defined between the part of the side wall 20S located over the shelf 20T of the inner pan 20 and the side wall 11S of the outer pan 11.

The mounting structure operates as follows. The oil in the engine 50 is reserved in the oil pan 10 upon stop of the engine 50. In this case, when the oil is cooled, the viscosity thereof is increased and accordingly, the lubricating performance is lowered. On the other hand, the temperature of the oil is desired to rise as quickly as possible in starting an engine. In view of this demand, the interior of the outer pan 11 is divided into the outer and inner chambers 18 and 19 by the inner pan 20 in the embodiment. The suction pipe 31 is disposed in the inner chamber 19. Accordingly, a higher priority is given to the oil in the inner chamber 19 when the oil is circulated into the engine 50. As a result, in the starting of the engine 50, the temperature of the oil is increased more quickly in this case than in the case where all the oil in the oil pan 10 is circulated. Furthermore, the outer and inner chambers 18 and 19 communicate with each other via the small lateral holes 23 formed through the inner pan 20. Accordingly, the oil is restricted from flowing through the holes 23 into the inner chamber 19 when the viscosity of oil is high in the starting of the engine 50. On the other hand, when the oil is subjected to heat such that the viscosity thereof is lowered, the oil flows from the outer chamber 18 into the inner chamber 19. More specifically, the oil is restricted from flowing from the outer chamber 18 into the inner chamber 19 immediately after starting of the engine 50, whereupon temperature rise of the oil is enhanced. Furthermore, after the oil temperature has been increased to a suitable value, the temperature of the oil in the inner chamber 19 is prevented from being excessively increased.

The engine 50 and oil pan 10 repeat thermal deformation with temperature changes in the engine 50 and oil. Each of the outer pan 11 of the oil pan 10 and engine 50 is made from a metal whereas the inner pan 20 of the oil pan 10 is made from a synthetic resin. Thus, the inner pan 20 has a thermal deformation ratio differing from those of the outer pan 11 and engine 50. Accordingly, when the engine 50 starts and the temperature thereof is increased, the inner pan 20 shrinks or expands relative to the outer pan 11 and engine 50. More specifically, since the inner pan 20 is made from nylon in the embodiment, the inner pan shrinks about 0.85 mm per 100 mm when subjected to heat.

In the embodiment, however, the flange 25 of the inner pan 20 is loosely fitted in the accommodation space 56 defined between the opening edges 12 and 52 of the outer pan 11 and engine 50. The inner pan 20 is thus held by the outer pan 11 and the engine 50 while being allowed to be thermally deformed. Consequently, an internal stress due to thermal deformation is hard to occur in the inner pan 20, whereupon the inner pan 20 can be prevented from cracking. Furthermore, the outer peripheral portions of the opening edges 12 and 52 of the outer pan 11 and the engine 50 are in abutment with each other without the flange 25 being held therebetween. Consequently, the sealing performance can be prevented from being reduced by creep deformation.

Furthermore, the embossments 26 are formed on the upper surface of the flange 25. The collapsed surface 54 of the engine 50 is formed with the recesses 57 in which the embossments 26 of the flange 25 are loosely fitted vertically. Consequently, the flange 25 can be prevented from falling off while being allowed to move in the accommodation space 56. Thus, the inner pan 20 can be rendered stable in the outer pan 11. Moreover, since the entire oil pan 10 is fixed to the engine 50 using the bolts B, the oil pan 10 can be attached to and detached from the engine 50 more readily than the conventional construction in which the inner pan 20 is separately bolted to the outer pan 11.

Figure 3:
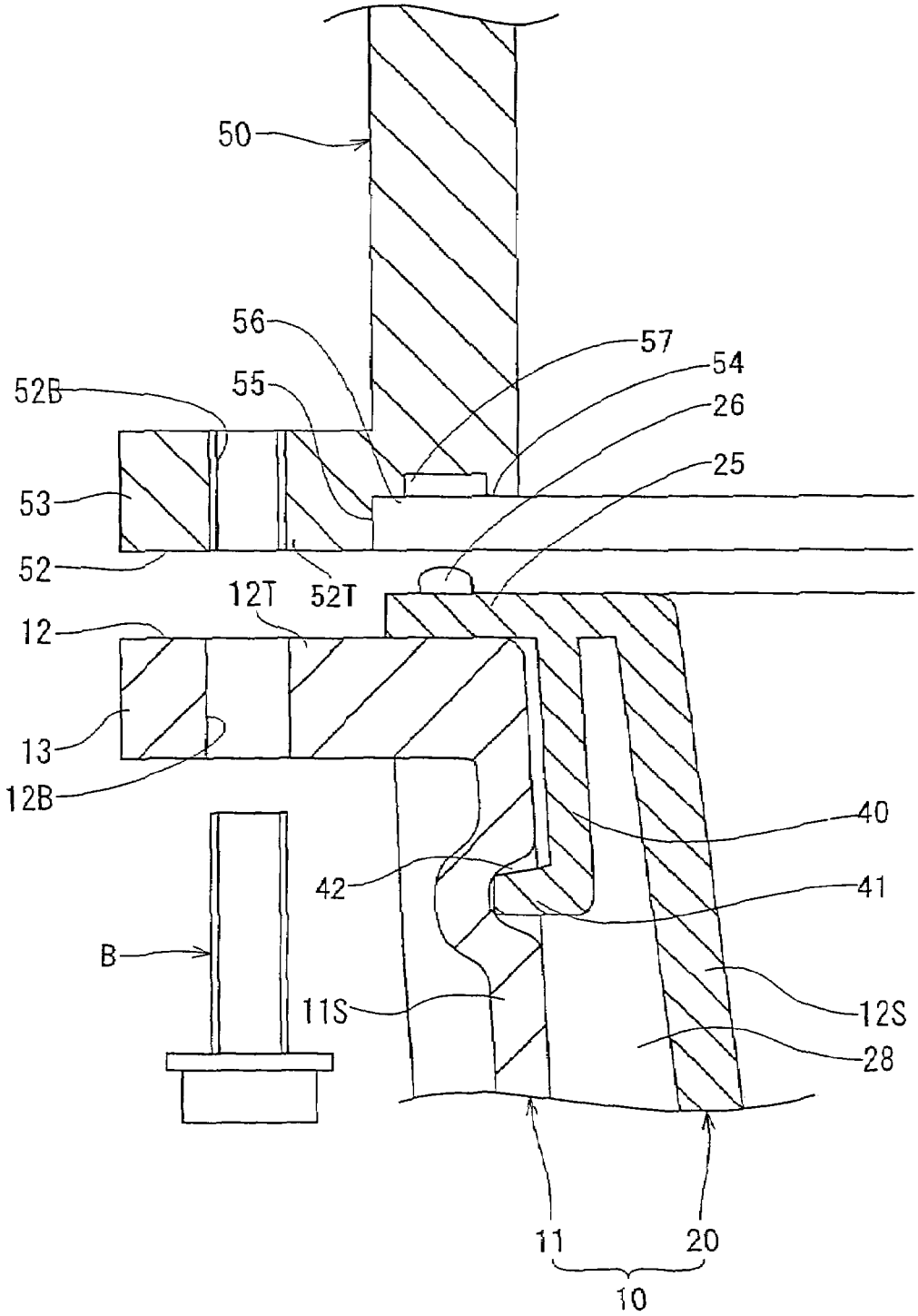
FIG. 3 is a partial side section of the engine and the oil pan of a second embodiment in accordance with the present invention.
Figure 4:
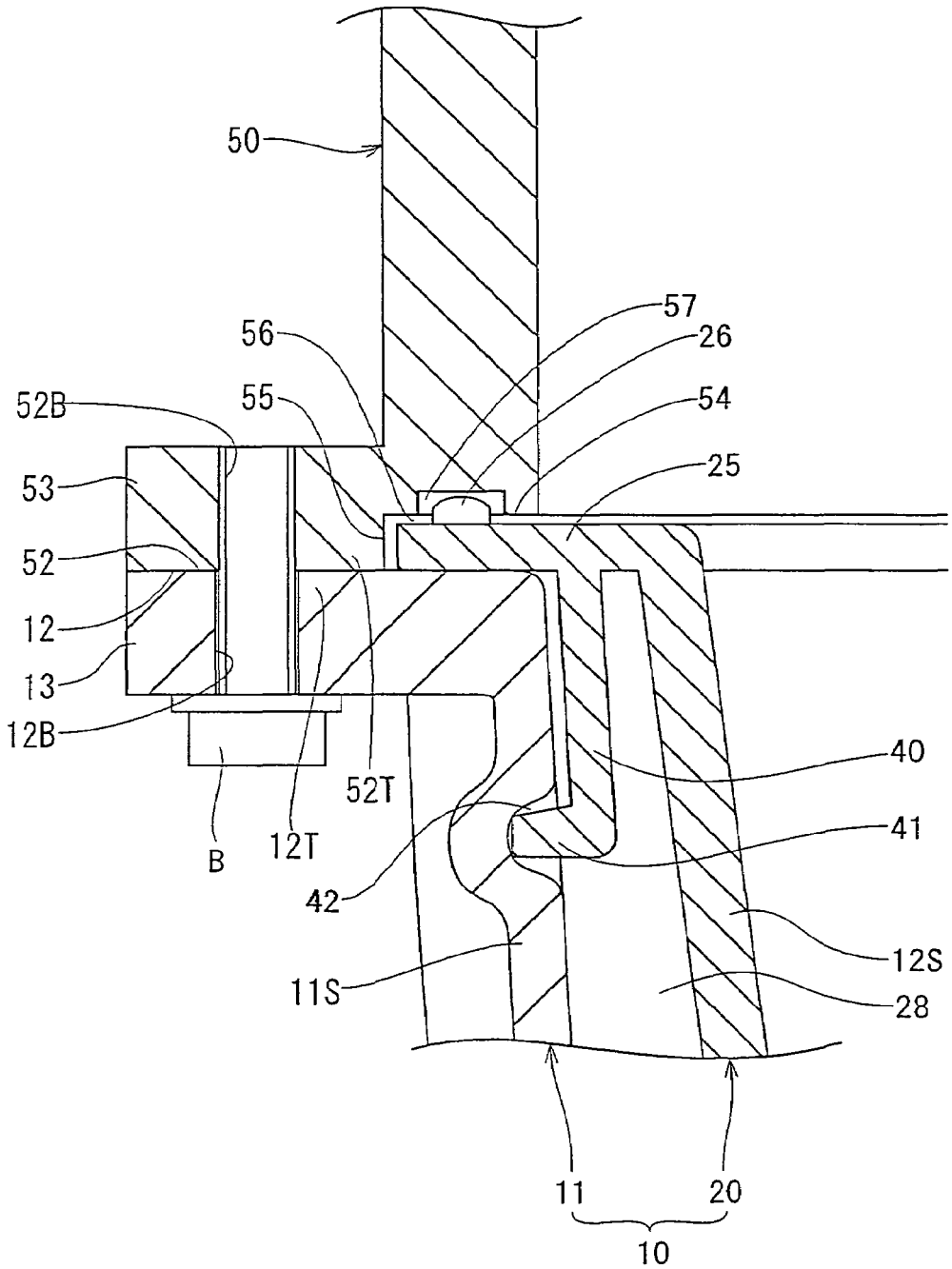
FIG. 4 is a partial side section of the engine and the oil pan.

FIGS. 3 and 4 illustrate a second embodiment of the invention. The inner pan 20 has a locking arm 40 extending downward from a proximal end of the flange 25 in the second embodiment. The locking arm 40 has a locking protrusion 41 formed on a distal end thereof so as to extend toward the side wall 11S of the outer pan 11. On the other hand, the side wall 11S has a side-wall recess 42 formed so as to correspond to the locking protrusion 41. The construction of the oil pan of the second embodiment is the same as the first embodiment in the other respects. Accordingly, identical or similar parts in the second embodiment are labeled by the same reference symbols as in the first embodiment and the description of these parts will be eliminated.

When the inner pan 20 has been assembled to the outer pan 11 so as to assume a normal position, the inner and outer pans 20 and 11 are prevented from falling off by the engagement of the locking protrusion 41 with the side-wall recess 42, thereby being integrated with each other. Consequently, the oil pan 10 can be attached to and detached from the engine 50 more efficiently.

Figure 5:
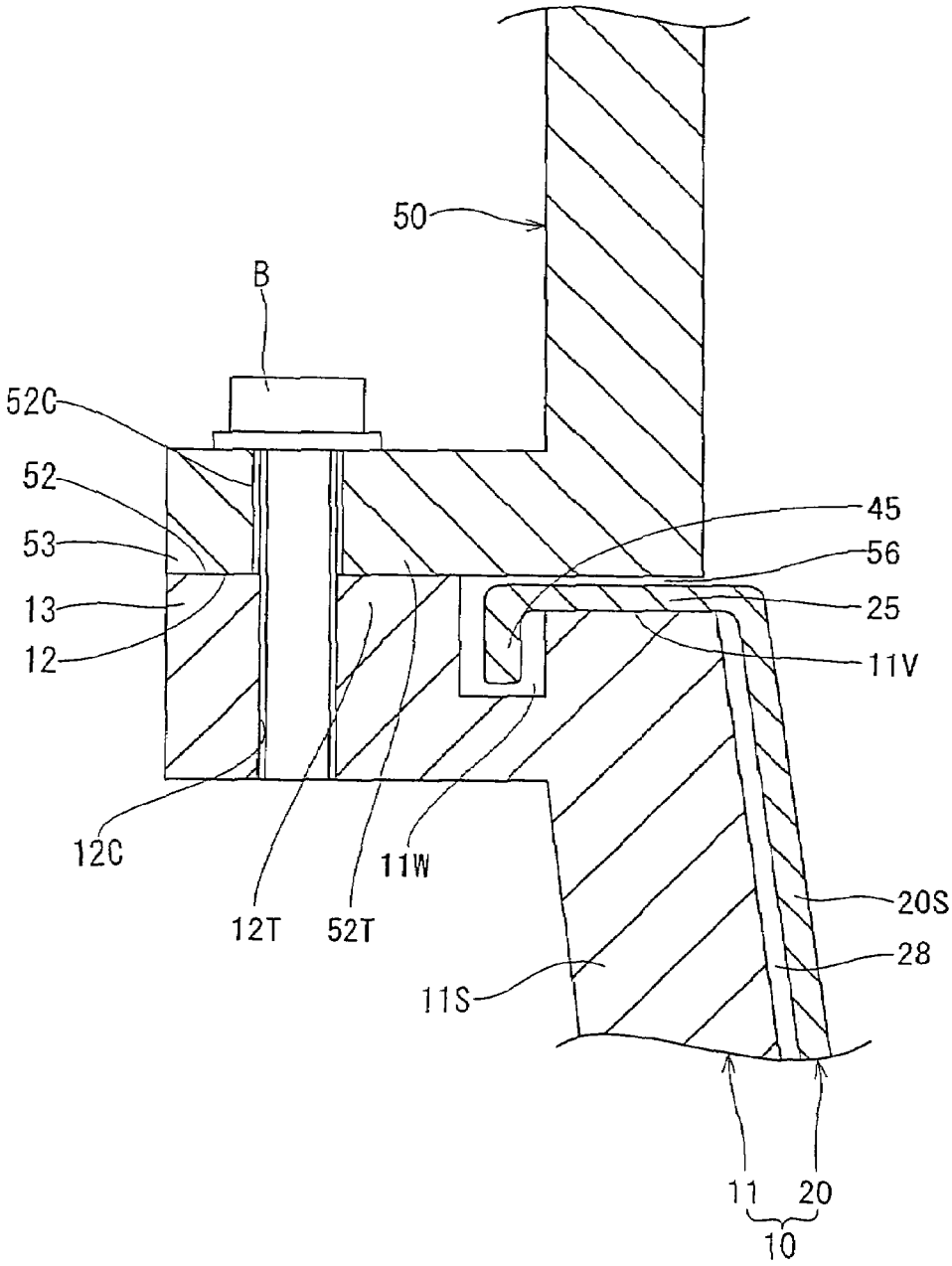
FIG. 5 is a partial side section of the engine and the oil pan of a third embodiment in accordance with the present invention.

FIG. 5 illustrates a third embodiment of the invention. The flange 25 of the inner pan 20 has a locking wall 45 extending downward from the distal end thereof. The outer pan 11 has a collapsed surface 11V formed by collapsing the inner peripheral portion of the opening edge 12 into a stepped shape. Further, the collapsed surface 11V includes a locking groove 11W formed by collapsing the outer edge thereof. On the other hand, the opening edge 52 of the engine 50 includes a flat surface opposed to the opening edge 12 of the inner pan 20. Furthermore, the outer pan 11 has female screw holes 12C formed at the opening edge 12 side and the engine 50 has bolt holes 52C at the opening edge 52 side. The bolts B inserted through the bolt holes 12B of the outer pan 11 from above are brought into threading engagement with the female screw holes 12C of the outer pan 11 respectively. The construction of the oil pan of the third embodiment is the same as the first embodiment in the other respects. Accordingly, identical or similar parts in the third embodiment are labeled by the same reference symbols as in the first embodiment and the description of these parts will be eliminated. The bolt holes 52C and the female screw holes 12C constitute the bolt engagement holes.

When the outer pan 11 is fixed to the engine 50 by the bolts B, the accommodation space 56 is defined between the collapsed surface 11V of the opening edge 12 of the outer pan 11 and the inner peripheral portion of the opening edge 52 of the engine 50. The flange 25 of the inner pan 20 is loosely fitted in the accommodation space 56, and the locking wall 45 is also loosely fitted in the locking groove 11W. Consequently, the third embodiment can achieve the same effect as the first embodiment.

The invention should not be limited to the foregoing embodiments. The following modified forms encompass the technical scope of the invention. Furthermore, the invention should not be limited to the modified forms but may be modified still further within the scope of the invention.

The flange 25 is prevented from falling off in the accommodation space 56 by the engagement of the rugged engagement portions (the embossments 26 and recesses 57) in the first embodiment. However, the flange 25 may be prevented from falling off from the accommodation space 56 by limiting a moving range of the flange 25 by a rigidity of the inner pan 20 without provision of the rugged engagement portions.

The flange 25 may protrude from an entire upper periphery of the inner pan 20 or from part of the upper periphery.

The foregoing description and drawings are merely illustrative of the principles of the present invention and are not to be construed in a limiting sense. Various changes and modifications will become apparent to those of ordinary skill in the art. All such changes and modifications are seen to fall within the scope of the invention as defined by the appended claims.

What is claimed is:

1. A mounting structure for an oil pan including an outer pan made from a metal and an inner pan made from a synthetic resin and fixed to an underside of an engine by bolts, the outer pan having an upper opening edge, the engine having an underside with an opening edge, the mounting structure comprising:

abutments provided on outer peripheral portions of the opening edges of the outer pan and the engine so as to abut against each other, respectively;

bolt holes formed through the outer peripheral portions of the opening edges so that the bolts are inserted through the holes respectively;

an accommodation space defined between inner peripheral portions of the opening edges of the outer pan and the engine by collapsing the inner peripheral portion of the opening edge of either outer pan or engine; and a flange protruding sideways from the inner pan and loosely fitted in the accommodation space.

2. The mounting structure according to claim 1, further comprising rugged engagement portions provided in the opening edge of the outer pan or the engine and the flange so as to be loosely fitted with each other vertically, respectively.

3. The mounting structure according to claim 2, further comprising inner pan retainers provided on the inner and outer pans so as to be engaged with each other respectively, the inner pan retainers retaining the inner pan at a normal position where the inner pan is assembled to the outer pan.

4. The mounting structure according to claim 3, wherein the flange has a proximal end and the outer pan has a side wall, the structure further comprising a locking arm extending downward from the proximal end of the flange and having a distal end with a locking protrusion, a side wall recess formed in the side wall of the outer pan so that the engagement protrusion engages the recess to be locked, wherein the locking arm and the side wall recess constitute the inner pan retainer.

5. The mounting structure according to claim 1, further comprising inner pan retainers provided on the inner and outer pans so as to be engaged with each other respectively, the inner pan retainers retaining the inner pan at a normal position where the inner pan is assembled to the outer pan.

6. The mounting structure according to claim 5, wherein the flange has a proximal end and the outer pan has a side wall, the structure further comprising a locking arm extending downward from the proximal end of the flange and having a distal end with a locking protrusion, a side wall recess formed in the side wall of the outer pan so that the engagement protrusion engages the recess to be locked, wherein the locking arm and the side wall recess constitute the inner pan retainer.

* * * * *